United States Patent [19]

Dicke

[11] 4,405,004

[45] Sep. 20, 1983

[54] DOVETAIL FIXTURE

[75] Inventor: William C. Dicke, Easley, S.C.

[73] Assignee: The Singer Company, Stamford, Conn.

[21] Appl. No.: 293,430

[22] Filed: Aug. 17, 1981

[51] Int. Cl.[3] ..... B27F 1/14

[52] U.S. Cl. ..... 144/87; 144/144.5 R

[58] Field of Search ..... 83/821; 144/87, 144.5

[56] References Cited

U.S. PATENT DOCUMENTS

| | | | |
|---|---|---|---|
| 1,679,074 | 6/1927 | Carter . | |
| 2,764,191 | 8/1953 | Hartmann . | |
| 3,057,383 | 11/1958 | Waite . | |
| 3,109,466 | 5/1961 | Jones . | |
| 3,800,840 | 4/1974 | McCord, Jr. . | |
| 3,834,435 | 9/1974 | McCord, Jr. . | |
| 3,935,779 | 2/1976 | Hildebrandt et al. | 83/821 |

*Primary Examiner*—W. D. Bray

*Attorney, Agent, or Firm*—Edward P. Schmidt; Robert E. Smith; Edward L. Bell

[57] ABSTRACT

A dovetail fixture for guiding a cutting tool in cutting mortises and tenons is described which can be simply used in cutting mortises and tenons. The fixture includes a molded base equipped with a horizontal table or work receiving surface and a sloped apron carrying spaced apart bosses defining a vertical work receiving surface. The surfaces are adapted to support work pieces in orthogonal positions with the end of a horizontal work piece in abutting relation with the end of a vertical work piece. Also included is a first clamping means adapted to clamp the horizontal work piece against the horizontal work receiving surface and a second clamping means adapted to clamp vertical work piece against the vertical work receiving surface in their abutting positions. A cutter guiding template is employed having at least one of its edges formed with a series of alternating guide fingers and slots. The template is adapted to overlie one of the work pieces and to be clamped thereupon in a position such that the outer edges of said set of slots and fingers is in alignment with the outer surface of the work piece.

2 Claims, 2 Drawing Figures

DOVETAIL FIXTURE

FIELD OF THE INVENTION

This invention relates to dovetail fixtures for clamping and holding orthogonally disposed work pieces and for guiding a cutting tool as it cuts interlocking tenons and mortises in the work piece for effecting dovetail corner joints.

BACKGROUND OF THE INVENTION

Dovetail fixtures of the type envisioned herein are described in U.S. Pat. Nos. 1,679,074, 2,764,191, 3,057,383, 3,109,466, 3,800,840, 3,834,435 and in other patents. Such fixtures includes a horizontal table and a vertical apron equipped with independent clamps by which the two work pieces, such as a drawer, box or bookcase sides and the like, can be rigidly held at right angles. A slotted guide member in the form of a comb or template is held against one of the work pieces to guide a router or similar cutting tool as the bit thereof traces the dovetail pattern.

It is very important to successful use of such fixtures that the horizontal table and the vertical apron define mutually perpendicular work supporting planes. This requirement, however, has heretofore made molding of such a fixture base from structural plastic extremely difficult since the molding process generally require that the apron slope or be more than 90 degrees from the table, to provide the necessary draft for removal of the molded part from the mold.

OBJECTS OF THE INVENTION

Bearing in mind the foregoing, it is a primary object of the present invention to provide a dovetail fixture having a base molded of structural plastic yet defining a horizontal work supporting table and a vertical work supporting apron.

Another primary object of the present invention, in addition to the foregoing object, is the provision of such a dovetail fixture wherein the apron comprises alternating portions of sloped and vertical configuration enabling easy removal thereof from the mold while still providing an as molded vertical work-piece supporting surface.

The invention resides in the combination, construction, arrangement and disposition of the various components parts and elements incorporated in improved dovetail fixtures in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment of modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, a dovetail fixture for guiding a cutting tool in cutting mortises and tenons is provided which can be simply used in cutting mortises and tenons. The fixture includes a base molded of structural plastic equipped with a horizontal table or work receiving surface and a vertical apron or work receiving surface. The surfaces are adapted to support work pieces in orthogonal positions with the end of a horizontal work piece in abutting relation with the end of a vertical work piece. Also included is a first clamping means adapted to clamp the horizontal work piece against the horizontal table or work receiving surface and a second clamping means adapted to clamp the vertical work piece against the apron or vertical work receiving surface in their abutting positions. A cutter guiding template is employed having at least one of its edges formed with a series of alternating guide fingers and slots. The template is adapted to overlie the horizontal work piece and to be clamped thereupon in a position such that the outer edges of the slots and fingers is in alignment with the outer surface of the work piece. The base is molded so that the apron portion comprises alternating portions of flat and sloped configuration, the flat portions being of trapezoidal side configuration with the flat faces thereof defining the work supporting surface orthogonal the table portion and the sloped portions of the apron and the sloped sides of the flat portions enabling easy removal from the mold.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
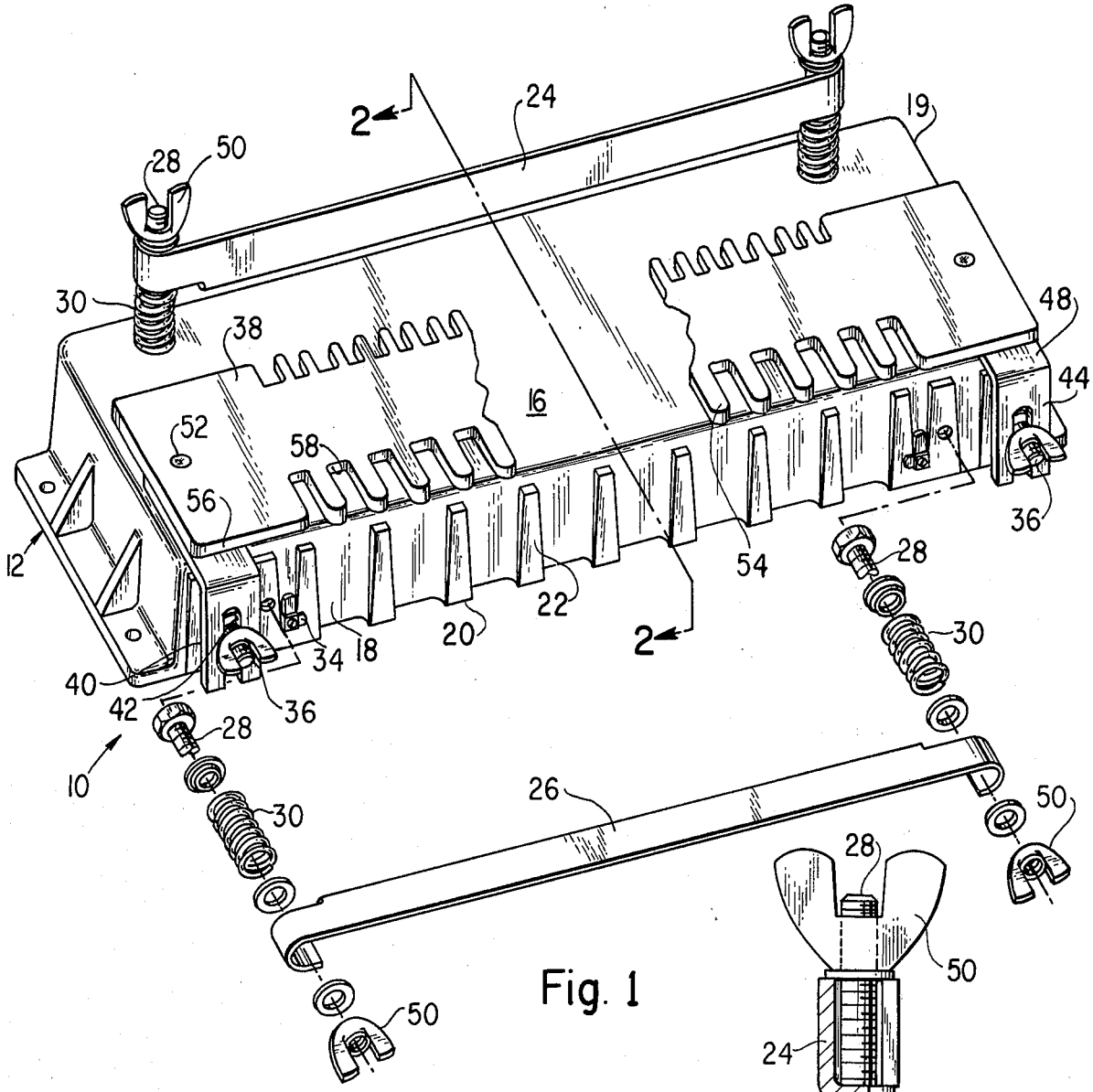
FIG. 1 is an exploded perspective illustration of a dovetail fixture constructed in accordance with the principles of the present invention.
Figure 2:
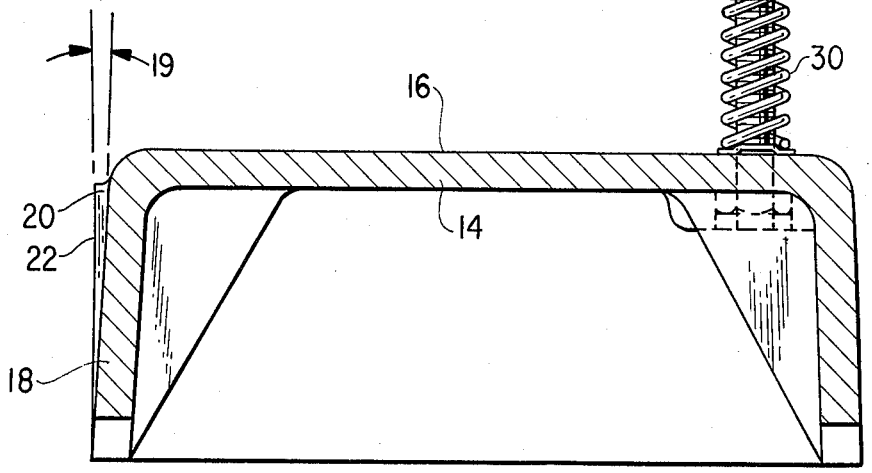
FIG. 2 is a cross-sectional illustration taken along line 2—2 of FIG. 1.

With reference now to the drawing, there is shown and illustrated a dovetail fixture constructed in accordance with the principles of the present invention and designated generally by the reference character 10. The fixture 10 of this invention is independent of the cutting tool in the sense that substantially any of the portable routers in use can be used with the dovetail fixture 10. Because of its simplicity and, hence, ease of manufacture, it can also be modestly priced.

The fixture 10 comprises a frame, body, or base 12 of generally open bottoned box-shaped configuration of unitary one-piece molded construction of a structural plastic such as for example, FOSTA TUFFLEX 702. The base 12 comprises a table portion 14 defining a first or horizontal work supporting surface 16 and a front apron portion 18. The front apron portion 18 depends from the table portion 14. The front apron portion 18 is sloped generally downwardly outwardly to provide a draft, for example 3°, relative the surface 16, as indicated by the arrow 19 for aiding in removal of the base 12 from the mold. Integrally molded on the front apron portion 18, however, are a series of spaced apart lands or trapezoidal bosses 20, the front face or outermost surface 22 of which is exactly orthogonal to the table surface 16, the sides of the lands or bosses 20 are also sloped, being provided with 3° side draft. The outermost surface 22 of the land or bosses 20 thereby define a second or vertical work supporting surface 22 orthogonally related to the first or horizontal work supporting surface 16. In other words, the surfaces 16 and 22 are perpendicular one another. Work pieces are clamp to the respective work receiving surfaces by clamping members or bars 24 and 26 which may comprise generally L-shaped formed sheet steel sections. The clamping bars 24 and 26 are held by screws 28 engaged in the table portion 14 and the apron 20, respectively. Compression springs 30 are provided around the screws 28, the surfaces 16 and 22 and the clamping bars 24 and 26 to bias the clamping bars 24 and 26 outwardly away from the respective work supporting surfaces 16 and 22. Thumb screws or knobs 32 are provided for moving the clamping bars 24 and 26 along the scrws 28 for clamping the work pieces against the work supporting surfaces 16 and 22.

The work pieces are laterally positioned relative one another by means of adjustable stops 34 screwed to the table portion 14 and the apron 20 as is well known to provide for proper alignment of the completed mortises and tenons.

The dovetail fixture 10 further comprises a pair of threaded support posts 36 extending through the apron for carrying a comb-like template 38. The template 38 is adjustably supported on the studs 36 by means of generally L-shaped angle brackets 40. The angle brackets 40 are each provided with an elongated slot 42 in one leg 44 thereof and with a threaded aperture in the other leg 48 thereof. In use, the slotted leg 44 is engaged over the stud 36 and clamped in position by means of a hand knob or a thumb screw 50. The template 38 is adjustably secured with the angle brackets 40 by means of flat head machine screws 52.

The template 38, as heretofore pointed out, is contructed and arranged to enable guidance of a router tool, or the like, for producing dovetails. Accordingly, the template 38 is provided with at least one set of spaced apart fingers 54 along an edge 56 thereof defining, therebetween, alternating slots 58 for guiding a router tool, or the like.

Although the invention has been described in terms of a preferred embodiment or modification, such technical equivalence to the means described as well as their combination, and such other embodiments or modifications as may be suggested to those having the benefit of the teachings herein are intended to be reserved should they be carried out according the spirit of the invention.

I claim:

1. Dovetail fixture for guiding a cutting tool in cutting mortises and tenons, comprising a molded base of one-piece unitary construction equipped with a horizontal table defining a first work receiving surface and a generally vertical apron sloped to provide draft for easy removal from a mold and carrying a series of narrow, vertically oriented bosses having flat faces orthogonal to said first work receiving surface defining a second work receiving surface adapted to support a pair of work pieces in orthogonal abutting relation, a first clamping means adapted to clamp one work piece against said first work receiving surface, a second clamping means adapted to clamp the other work piece against said second work receiving surface, a cutter guiding template having at least one of its edges formed with a series of alternating guide fingers and slots, the template being adapted to overlie one of the work pieces and to be clamped thereupon in a position such that the outer edges of said set of slots and fingers is in alignment with the outer surface of the work piece.

2. Dovetail fixture defined in claim 1 wherein said bosses are of generally trapezoidal elevational configuration, the sides being sloped to also provide side draft for easy removal from the mold.

* * * * *